US007954734B2

(12) United States Patent
Hata

(10) Patent No.: US 7,954,734 B2
(45) Date of Patent: Jun. 7, 2011

(54) DISRUPTOR SYSTEM FOR DRY CELLULOSIC MATERIALS

(75) Inventor: Seiji Hata, Tokyo (JP)

(73) Assignee: Biomass Conversions LLC, Palos Verdes Estates, CA (US)

( * ) Notice: Subject to any disclaimer, the term of this patent is extended or adjusted under 35 U.S.C. 154(b) by 0 days.

(21) Appl. No.: 12/282,443

(22) PCT Filed: Mar. 12, 2007

(86) PCT No.: PCT/US2007/063797

§ 371 (c)(1),
(2), (4) Date: Feb. 11, 2009

(87) PCT Pub. No.: WO2007/106773

PCT Pub. Date: Sep. 20, 2007

(65) Prior Publication Data

US 2009/0224086 A1 Sep. 10, 2009

Related U.S. Application Data

(60) Provisional application No. 60/781,429, filed on Mar. 10, 2006.

(51) Int. Cl.
*B02C 19/00* (2006.01)

(52) U.S. Cl. ..... 241/28; 241/29

(58) Field of Classification Search ..... 241/28, 241/29, 110, 116, 126

See application file for complete search history.

(56) References Cited

U.S. PATENT DOCUMENTS

| | | | | |
|---|---|---|---|---|
| 233,383 | A * | 10/1880 | Tuck | 241/116 |
| 614,074 | A | 11/1898 | Banfield | |

FOREIGN PATENT DOCUMENTS

| | | | |
|---|---|---|---|
| DE | 3504853 | C1 | 3/1986 |
| GB | 278069 | A | 9/1927 |
| GB | 863249 | A | 3/1961 |
| GB | 2160121 | A | 12/1985 |
| WO | WO-02057317 | A1 | 7/2002 |

* cited by examiner

*Primary Examiner* — Mark Rosenbaum

(74) *Attorney, Agent, or Firm* — Venable LLP; Stefan J. Kirchanski

(57) ABSTRACT

Cellulosic biomass is reduced to a micropowder with particles having average diameters below 5-10 micrometers with a significant fraction of the particles have diameters below 1 micrometer. Biomass (e.g., wood, agricultural waste or other plant materials) is first processed into pieces having a maximum diameter of about 10 mm. This is then dried to reduce its water content to no more than about 15% by weight and introduced into a disruptor which reduces the particle size to about 1 mm. Next the biomass is processed with a disc mill where edges of rotating discs travel along a groove pressing and squeezing the biomass, thereby breaking the biomass pieces into smaller and smaller particles. The resulting micropowder is extremely susceptible to enzymatic or chemical hydrolysis into constituent sugars. In addition, the micropowder can be suspended in an air stream and burned directly to provide heat to boilers and similar devices.

4 Claims, 8 Drawing Sheets

DISRUPTOR SYSTEM FOR DRY CELLULOSIC MATERIALS

CROSS-REFERENCE TO PRIOR APPLICATIONS

This application is US national phase application based on PCT Application No. PCT/US2007/063797 with an international filing date of Mar. 12, 2007 and claims priority from and benefit of U.S. Provisional Patent Application No. 60/781,429, filed on 10 Mar. 2006 which application is incorporated herein by reference to the fullest extent permitted by applicable laws and regulations.

U.S. GOVERNMENT SUPPORT

NA

BACKGROUND

1. Area of the Art

The application concerns a device and method for reduction of cellulosic plant materials to micrometer and submicrometer particles which are ideal for enzymatic or chemical hydrolysis into sugars or for direct combustion.

2. Description of Related Art

For the last several decades there have been repeated warnings concerning energy shortages. The general pattern has been for energy prices to spike sharply resulting in an economic downturn which temporarily takes the pressures off of energy supplies. At the same time half-hearted energy conservation measures are established. This results in a drop in energy prices so that rampant consumption resumes and energy conservation and long-term energy planning are completely forgotten. Nevertheless, energy supplies are finite. Best estimates are that oils supplies will be mostly depleted within forty or so years. Even with the discovery of new oil fields and improved recovery from existing fields, this estimate is highly unlikely to be increased even two-fold to eighty years. Thus, baring drastic improvements in efficiency or tremendous conservation efforts, some living individuals who are now alive will almost certainly see the end of a petroleum powered world just as our ancestors not that many generation back saw the end of a horse powered technology. Some have pinned their hopes on nuclear power. Unfortunately, the supply of nuclear fuel is also limited particularly considering the inefficient nuclear reactors now in use. Furthermore, the nuclear waste problem is so critical that our civilization could not safely depend on nuclear energy even if the fuel supply were unlimited.

The picture for other popular fossil fuels is not that much brighter than that for oil. It is estimated that current natural gas supplies will be exhausted in about sixty years. Even if the estimated time is doubled, it would appear that wide spread dependence on natural gas will end in no more than one hundred and twenty years. Coal is perhaps the most abundant fossil fuel; there is thought to be at least a 200 year supply. That means that unless alternative energy technologies are soon developed our civilization will become entirely dependant on coal within the next fifty to one hundred years. Yet coal is the fossil fuel that was developed earliest and was largely supplanted by oil and natural gas because coal combustion is dirty and leaves large volumes of ash. Not to mention the terrible environmental costs of coal mining.

However, it is probably not a shortage of coal that will necessitate an abandonment of coal use. Rather it will be the environmental consequences of continued release of fossil carbon dioxide into the atmosphere. This problem, often called global warming, results from combustion of any fossil fuel. It is just that oil will probably be exhausted before the full brunt of the problem is felt. Global warming is probably not a good term because while overall global temperatures are increasing due to excess atmospheric carbon dioxide, the real problem is not warming per se but is drastic climate change. The Earth's climate is always changing—at one time more rapidly that at other times. For example, during the relatively recent drastic climate change that took place at the end of the ice age, climate change was sufficiently slow that living organisms could either adjust to the new climate or relocate to a more amenable climate. Thus as the glaciers retreated and temperatures warmed "arctic" species adapted to cold moved north or into higher elevations. There is every indication that the climate changes resulting from burning of fossil fuels will be too rapid to allow living organisms to relocate. The result will be extreme loss of species and overall biological diversity with a species extinction rate much higher than the already high extinction rate caused by the spread of our civilization.

Until some entirely new energy source such as fusion is perfected, the best answer to the energy conundrum would appear to be greatly increased conservation coupled with exclusive use of renewable energy sources. Most energy on our planet comes ultimately from the sun. Therefore, solar energy in the form of photovoltaic electricity and solar heating are ideal. However, solar energy cannot satisfy all of our needs. Hydroelectric power and wind generated power are two other forms of renewable solar-based energy. None of these power sources result in changes in atmospheric carbon dioxide. Biomass energy (i.e., wood and other plant materials) may be the ideal complement to solar energy. This may seem surprising because biomass energy is normally obtained through combustion of the biomass, and such combustion releases carbon dioxide into the atmosphere. However, biomass is renewable. If plantations of green plants are grown to produce biomass, the released carbon dioxide will quickly be sequestered in new plant material. Thus, the carbon dioxide is used over and over, and the total level of atmospheric carbon dioxide does not continue to increase, as with the burning of fossil fuels. The real problem is how to integrate biomass energy into our economy. There is presently a marked shortage of wood burning stream trains and wood burning automobiles. Nor is direct combustion of biomass in power plants particularly viable because our electrical generation systems are adapted to use liquid oil or natural gas or even pulverized coal.

There has been considerable effort to produce liquid fuel (primarily ethanol) from biomass. This involves fermentation of sugars derived directly from plant products or indirectly from the digestion of cellulosic biomass. The technology for fermenting directly derived sugars is well established. Unfortunately, the greatest potential source of energy is in cellulosic biomass. The conversion of cellulose into fermentable sugar is difficult and at the present not terribly efficient. Typically enzymes or acids are used to hydrolyze the cellulosic biomass into fermentable sugars. Adequate mechanical pretreatment of the biomass is essential. In some processes the biomass is chemically pretreated and then "exploded" by rapid changes in temperature and pressure. Such processes may create large amounts of hazardous chemical waste. Other processes cook wood chips in acid in devices rather like those used to produce wood pulp for paper manufacturing. To date none of these approaches has proven to be highly successful.

The inventor believes that most of the problems of the present technology can be solved by reducing biomass into sufficiently small particles. The inventor has found that such particles (called cellulosic micropowder) can be readily hydrolyzed into sugars and other organic monomers either by means of enzymes or by means of chemical hydrolysis. Probably because of the very small size of the particle, hydrolytic enzymes are far more effective than they are on cellulosic biomass prepared in other ways. Furthermore, micropowder prepared according to the present invention can be directly burned with a spray-like injector not completely unlike a liquid fluid. The key is to prepare extremely fine and uniform micropowder particles.

There are a variety of small devices (generally called "mills") that are used to disrupt small samples of a variety of organic and inorganic materials. For example, a cutting mill that uses rotating sharp edges can reduce many materials to the 200 μm size range. A cross beater mill adds crushing action to cutting to further reduce processed materials to the 100 μm size range. Rotor beater, rotor centrifuge and vibrating disk mills can further reduce many materials to a 50 μm size range. In comparison to biomass metals have a crystal structure, so that even small particles are very strong. Nevertheless, the ball mill, a popular industrial machine, is capable of shattering the crystal structure of metal particles into smaller sub-particles at a 5 μm size range (or even slightly smaller). However, the typical ball mill does not generally work well on biomass fiber materials perhaps because the biomass is resilient and generally does not behave in a crystalline manner. This notwithstanding, a ball mill with very small balls is able to achieve some limited disruption of biomass fibers. However, none of these prior art devices are practical at an industrially scale. The amounts of material processed are typically a few grams to a few hundred grams. Furthermore, many devices that depend on "cutting" employ sharp edges that rapidly become dulled by attempts to process large volumes of material.

The inventor earlier developed a system to reduce biomass into micropowder using a combination of mechanical force and water addition. (See WO/2002/057317). The micro-powder produced by that method is readily hydrolyzable into fermentable sugars through action of enzymes. However, that process requires repeated addition and removal of water and prolonged mechanical agitation which increased the energy expenditure needed to produce the micropowder. While the overall energy budget of that process was positive, the inventor has continued to work on the problem until the improved method of producing micropowder disclosed herein was perfected.

DESCRIPTION OF THE FIGURES

FIG. 5 showing edge extensions.

DETAILED DESCRIPTION OF THE INVENTION

Figure 1:
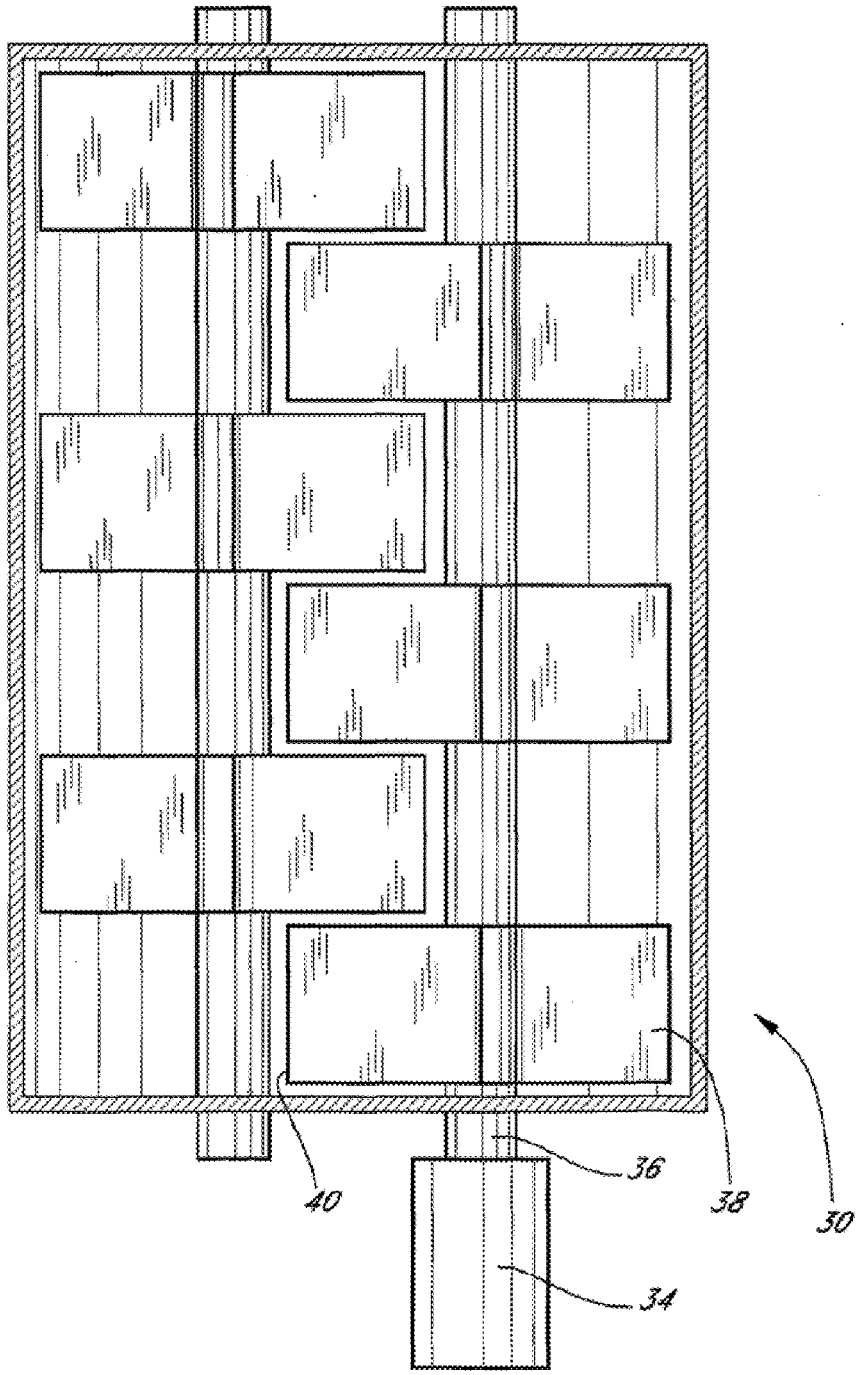
FIG. 1 shows a disrupter used to reduce biomass to millimeter dimension particles.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an apparatus and an improved essentially mechanical process to pretreat a variety of types of cellulosic biomass to produce micro-powder which is readily hydrolyzable and readily susceptible to combustion.

The present inventor has unexpectedly found a new dry mechanical method of disrupting cellulosic biomass to extremely small particles that readily undergo enzymatic or other chemical hydrolysis as well as oxidation (combustion). Plant biomass consists of primarily of cellulosic cell walls. In general, cellulosic biomass cannot be readily dissolved with in any solvent. The paracrystalline structure of cellulose and the composite structure formed by the "cementing" of lignin around the cellulose are the main reasons for this insolubility. However biomass can be broken down through a slow biodegradation that involves both fermentation and oxidation. Most of these biodegradation reactions operate in a solid-liquid phase on the surface of the biomass.

Plant biomass such as wood has long been used to make paper while other forms of biomass have been used to produce fiber (textiles). Paper production involves extraction by means of industrial processes that uses chemicals and large amounts of water. The natural cement (middle lamella) between the cell walls of wood cells is chemically dissolved, and the tangled cell walls (fibers) are suspended in water to form a wood pulp slurry. In the case of textiles the individual cell walls (fibers) are mostly separate and unattached one to another so that such complex processing is not required. (Although production of linen, for example, requires a digesting process usually called "retting.") Because the cellulose is essentially insoluble in water, the fibers are stable in water. However, such plant fibers do absorb water and swell to some degree. After swelling biomass can generally be dried to return to its original shape. It has generally been believed that mechanical processes are not capable of reducing cellulosic biomass much below the level of individual cell walls although mechanical disruption can fragment the individual fibers (i.e., cell walls) to some degree.

An industrial scale process is needed in which a simple process further reduces the cellulosic biomass into micropowder. The inventor's original process involved the repeated addition and removal of water. Cellulosic biomass, especially in living plants is hydrated. All living cells have a high water content, and in living plants the walls of many non-living cells are used as conduits for water further guaranteeing that the biomass remains hydrated. In the previous process it was necessary to first remove excess water and then cycle the addition and removal of water.

The improved process begins with an initial mechanical disruption of cellulosic biomass. Shredding and grinding machinery similar or identical to that used in the earlier process is used for the initial processing. It has been found that it is advantageous to reduce the biomass to particles having an average maximum diameter of about 1 mm. As will be explained, this is conveniently done in stages. However, there is no requirement to use the exact steps or apparatus discussed. Any procedure that reduces the biomass to particles of about 1 mm diameter will work. Although the initial processing can occur on either "native" (i.e., wet) biomass, it has been found that the machinery currently being used operates more rapidly and more efficiently on biomass that contains a reduced level of water. Because the later steps of the process require biomass with a reduced level of moisture, it is convenient to dry the biomass as a first step or at least after the biomass has been reduced to particles about 5-10 mm in diameter. The first step of the new disruption process is to reduce the size of the pieces of biomass to about 5-10 mm in diameter by use of an ordinary wood shredder or chipper or other appropriate mechanical device. These starting particles have water contents of between about 20 and about 80% by weight. Before further disruption can proceed efficiently the particles must be dried until their water content is less than about 15% by weight. Drying is achieved by standard methods. In the examples presented here the plant material (5-10 mm pieces) was heated to at least about 80° C. to ensure rapid drying. It will be appreciated by those of skill in the art that other less energy intensive drying methods can be employed as well. Solar energy or waste industrial heat can be used to dry the biomass.

In the inventor's earlier disruption process addition of water was used to weaken the hydrogen bonds holding together the polysaccharide polymers that formed the biomass. In this new dry method the opposite approach is utilized; removal of water increases the stiffness of the biomass so that mechanical disruption is more effective. The central step of the process relies on a special piece of equipment called the microdisrupter which has been optimized for sub-micrometer powder production. The total process from wood (for example) to micropowder includes the following steps: (1) feedstock harvest; (2) feedstock transportation; (3) reduction to 5-10 mm scale (shredding and planning/ chipping); (4) drying (can occur prior to shredding and chipping); (5) disruption to millimeter size particles; (6) disk mill reduction to 100 micrometer and under particle size with size classification of particles; and 7) micro-disrupter/mixer treatment to produce micrometer and submicrometer micropowder.

A commercial planar-shredder or chipper is used to reduce the biomass to a 5-10 mm scale. These devices are widely used to chip wood and brush and generally include one or more cutting edges on a rotating shaft. The devices usually have some sort of screen or sieve so that large pieces of biomass can be processed further while the smaller pieces fall through. Generally a screen or sieve that produces pieces with a maximum dimension of about 3-5 mm is optimal. As already mentioned material to be shredded can be dried first or it can be dried after shredding/planning. Drying is advantageously carried out at a temperature of generally about 80° C. or higher although drying at a lower temperature for a longer time is perfectly viable. It has been found that the planning-shredding process is more efficient on dry material; 25 kg of adequately dried biomass can shredded in 10 minutes or less while the same quantity of wet biomass may require an hour or more for adequate shredding.

It is advantageous to reduce the chipped biomass to particles having a scale of about 1 mm. A wide variety of grinding devices are available to achieve this end. The inventor has found it effective to utilize the disrupter he developed for his earlier process. In the disrupter device 30 of FIG. 1 a plurality of counter rotating shafts 36 (here two) bear rigid paddles 38 that are spaced apart so that they come into relatively close contact (about 1 cm clearance) during rotation. The shafts 36 are horizontally oriented and are disposed near the bottom of the hopper-like container 32. The shafts 36 are counter-rotated by motors 34 (only one shown) at a seed of a few hundred RPM or less. Biomass is fed into the device and disrupted by the paddles. Using such a device 25 kg of biomass can be reduced from a particle size or around 3-5 mm to a particle size of less than 1 mm in 60 min or less.

The inventive process then uses a disk mill and micro-disruptor/mixer to reduce biomass to particles of a micrometer to submicrometer scale. The disk mill is effective at rapidly reducing the biomass from just less than 1 mm in scale to a scale of about 100 μm. The micro-disruptor/mixer can efficiently reduce the 100 μm particles to the final scale of micrometer to sub micrometer. It will be appreciated that if the disk mill is operated for a very long time, it can reduce the biomass to particles smaller than 100 μm; however, by moving the material from one type of apparatus to another it is possible to produce micropowder more rapidly with a lower expenditure of energy.

The precise water content of the particles is important in the overall process. As explained below one version of the disk mill is particularly sensitive to excess water. The disk mill device contains rotating discs which disperse the dried biomass particles as they are added. The disk edge which interacts with the particles does not have to be sharp because no actual cutting of the particles occurs. Rather the particles are repeatedly pressed or squeezed (sheared) as they contact the rotating disruptor discs of the disk mill. The pressing or squeezing gradually breaks the particles down into smaller and smaller structures which are kept separate from each other by the constant agitation of the rotating discs. Initially the individual fibers (cell walls) become separated. Then the cell walls are broken into smaller and smaller particles. The cell wall is mainly composed of cellulose microfibrils complexed with hemicellulose and lignin. Most likely, the repeated flexing and squeezing of the particles by the discs result in separations along zones of weakness at the junction of the cellulose, hemicellulose and lignin subcomponents of the biomass. As the biomass particles become smaller and smaller evaporation from the greatly increased surface area is enhanced so that little or no additional heat is needed to effect optimum drying.

After the biomass has been treated with the disk mill, it experiences a final treatment with the micro-disruptor/mixer. This unit is like a miniature version of the disruptor pictured in FIG. 1. The pictured device is about 53 cm by 90 cm and 100 cm along the shaft with 2 kW motors. The diameter measured according to the blades or paddles is about 35 cm. The micro-disruptor/mixer is only 50 cm along the axis and is proportioned accordingly but because of the higher speed uses 3.7 kW motors. In the disruptor/mixer two spaced apart rotating axels bearing interspaced paddles rotate at high speeds in opposite directions within an enclosure. The axels are capable of rotating at 12,000 RPM however friction caused by the biomass particles generally reduces the practical rate of rotation to 4,000 RPM or lower (but at least several thousand RPM). The particles are suspended in air by the rotation and the countervailing rotation stresses and tears the particles apart and disaggregates particles that have become agglomerated in the disk mill. In this final stage the particles are reduced to single micrometer or submicrometer size. A micro-disruptor/mixer can process 25 kg of 100 μm particles from the disk mill into particles of a micropowder having a micrometer-submicrometer scale within 60-120 min.

The end product of the processing is micropowder. By micropowder is meant powdered biomass wherein the particles have an average size of no more than about 2-3 μm but with a significant proportion of submicrometer particles. It will be understood that the average processing times mentioned below produce micropowder with these characteristics. Classification (that is, sorting by size) of the micropowder allows the larger particles to receive additional processing, thereby yielding a larger proportion of submicrometer particles. Uses of the micropowder include enzymatic digestion to yield sugars (generally followed by fermentation to alcohol) or direct combustion. Micropowder with a 2-3 μm average particle size is suitable for such applications, but in some processes there may be an advantage to using micropowder having a larger proportion of submicrometer particles. Increasing the processing time, particularly in the micro-disruptor/mixer, increases the proportion of sub-micrometer particles. It will be appreciated that additional processing to produce a larger proportion of submicrometer particles requires more time and energy. A cost-benefit analysis can determine the optimal micro-powder size range for each particular use.

The inventor had produced two different versions of the disk. The first device was not intended as a readily scalable device whereas the second device was intended as a scalable device and prototype for industrial scale micropowder production. It was subsequently discovered that the most expedition results are achieved by preprocessing using the second device followed by final disk mill treatment with a device of the first type. That is, optimal disruption can be attained by a device of the first type, but overall throughput is relatively low. The throughput of a device of the second type is better, but it takes excessive processing times to achieve a large proportion of submicrometer particles in the micropowder. However, by processing the output of the device of the second type with the device of the first type, micropowder having a significant proportion of submicrometer particles can be readily and efficiently attained. Replacing the first disk mill treatment with disrupter treatment has also proved to be expeditious. At the present time use of the disrupter followed the disk mill of the first type is the preferred arrangement.

Figure 2:
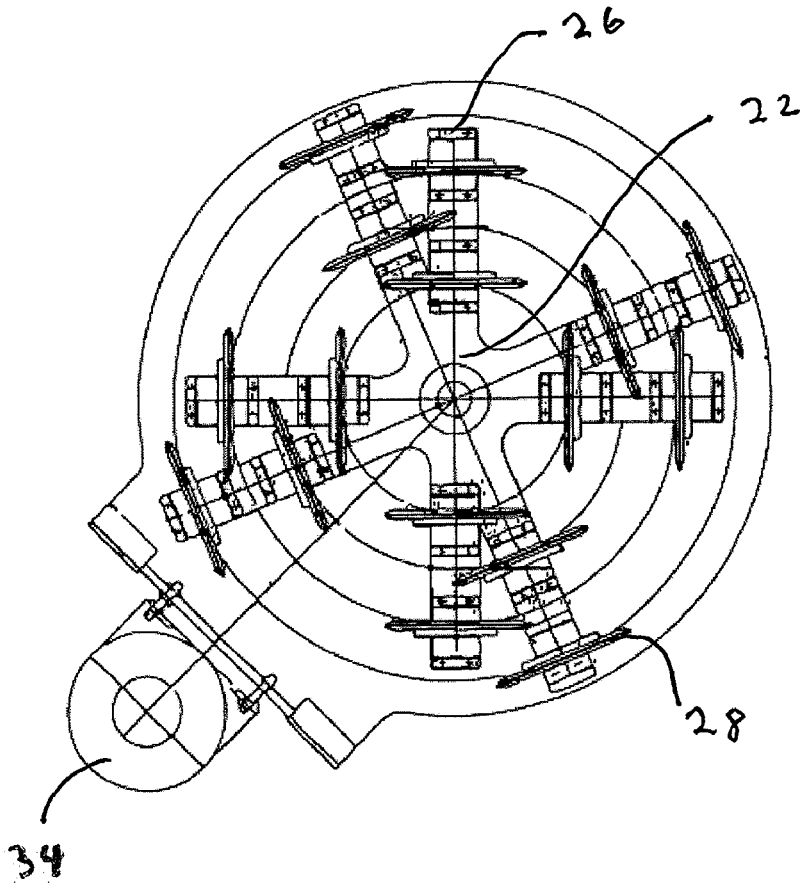
FIG. 2 shows a diagram of a rotary disk mill as seen from above.
Figure 3:
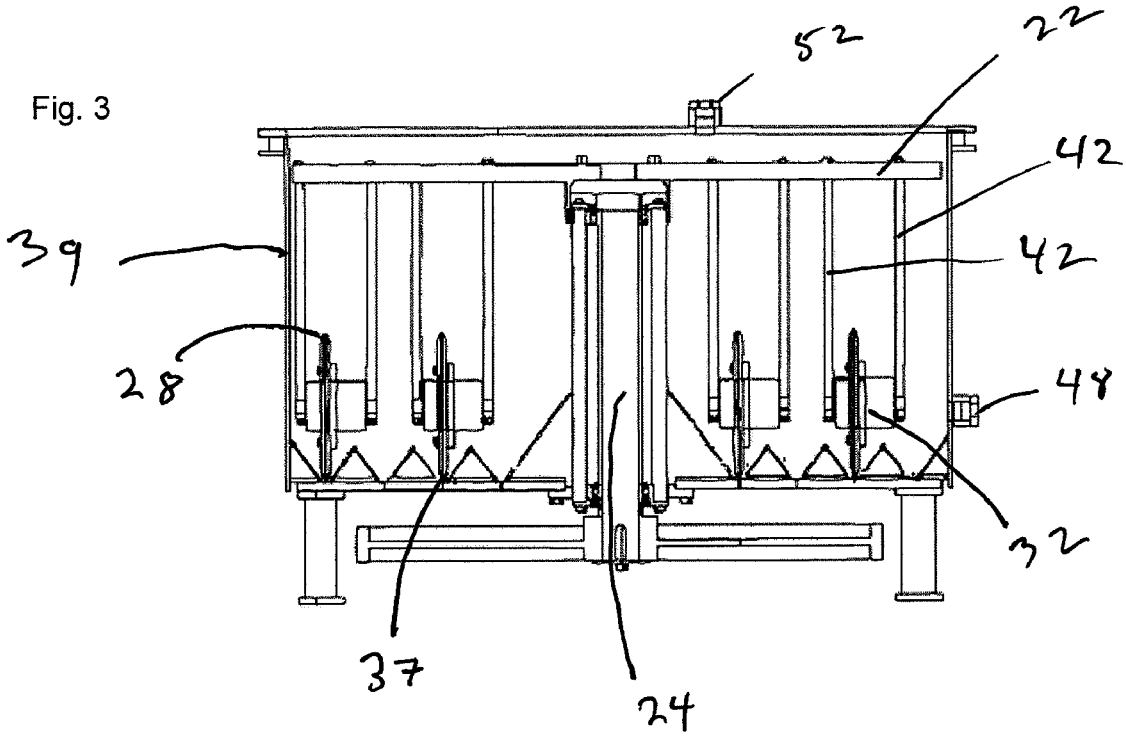
FIG. 3 shows a diagrammatic side view of the device of FIG. 2.
Figure 4:
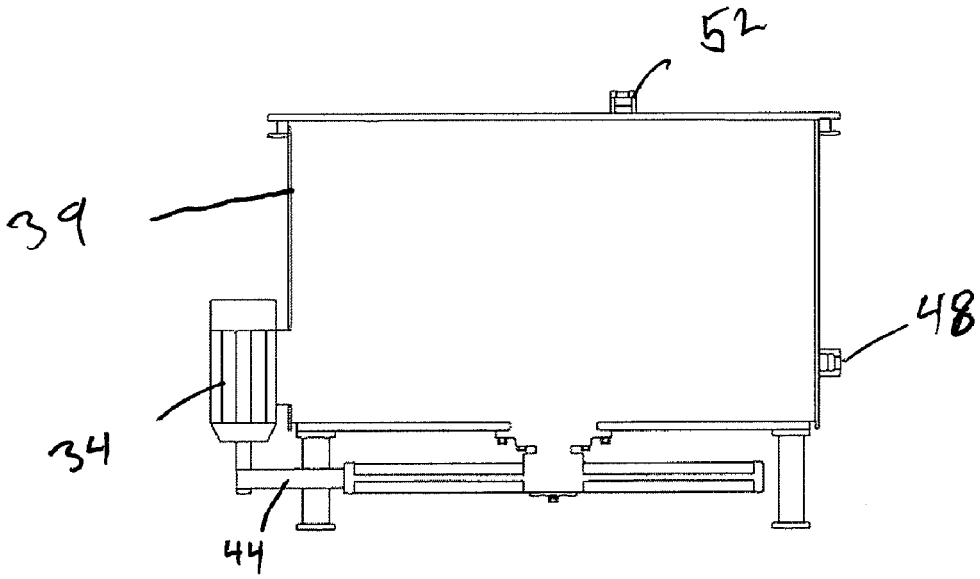
FIG. 4 shows a side view of the outside of the device of FIG. 2.

By examining the structures of these different devices the operating principles and parameters of the invention will become apparent. FIG. 2 shows a diagram of a rotary disk-based micro-disruptor as seen from above. In this device a double "X" shaped arm system 22 (that is, four separate arm segments) is coupled to an axle or central shaft 24 so that the arm system 22 can rotate around the center. The X-arm system 22 is a convenient structure, but it will be apparent to one of ordinary skill in the art that any member (an arm or disk, for example) disposed to rotate about the center can be substituted for the X-arm system 22. Each of the arms 26 bears two rotating discs. As seen in FIG. 3 each disk 28 is connected to a horizontal axle 32 each of which is supported by a pair of brackets 42 depending from one of the arms 26. Each disk 28 is aligned so that it rolls along the bottom of one of four V-shaped concentric grooves 37 that occupy the floor of an enclosure 39 that contains the X-arm 22. The four successive concentric tracks are about 330 mm, 490 mm, 650 mm and 810 mm in diameter. The V-grooves 36 have a flat bottom about 8 mm wide. The working parts are all constructed from stainless steel. When the device operates, a motor 34 is connected by means of a belt 44 to the lower terminus 46 of the central shaft 24 causes the X-arm system 22 to revolve within the enclosure 39 at a speed of about 120 RPM. The discs 28 move along the bottom of the V-shaped grooves 37. The structure of the horizontal axle 32 is such that the discs are mounted with some flexibility allowing them to respond to irregularities and navigate the circular V-groove 37. Any other suitable mechanical arrangement besides the shaft and belt can be used to cause the X-arm system 22 to rotate around its center.

The unit is structured so that the disk 28 does not actually touch the bottom or sides of the V-groove 36. The edge of each disk 28 is somewhat tapered to match the V-groove 37 so that there is normally a clearance between the surfaces of the disk 28 and the adjoining surfaces of the V-grooves 37. Cut up pieces of biomass are introduced into the unit through an entry port 48 on the lower vertical side of the unit and fall into the V-grooves 37. The biomass fills the clearance between the disk 28 and the walls of the V-groove 37. The moving disk 28 crushes the biomass and the resulting friction causes the disk to revolve and displace/distribute the biomass. The repeated crushing and shearing action tears the pieces of biomass apart resulting in smaller and smaller particles. This is where the degree of moisture in the biomass is particularly important. If the biomass is too moist, it will stick together in large clumps which impede the smooth motion of the discs 28 and may even cause a disk 28 to partly jump out of its V-groove 37. During this disruption process, the larger pieces fall back into the V-grooves 37 for further processing while the smallest particles are whipped into the air by the motion of the discs 28 and can be withdrawn from an exit port 52 on the upper cover of the unit. When operated in a batch mode, the unit can process about 10-15 kg biomass in 20-30 min. When operated in a continuous flow mode about 0.5 kg of material is added (and withdrawn) per minute. The most significant drawback of this configuration is that overly moist biomass may clog the V-grooves 37 causing the discs 28 to track improperly. If the material is too moist the particles clump and completely prevent further processing. This necessitates shutting down the unit to clean out the grooves 37.

Figure 5:
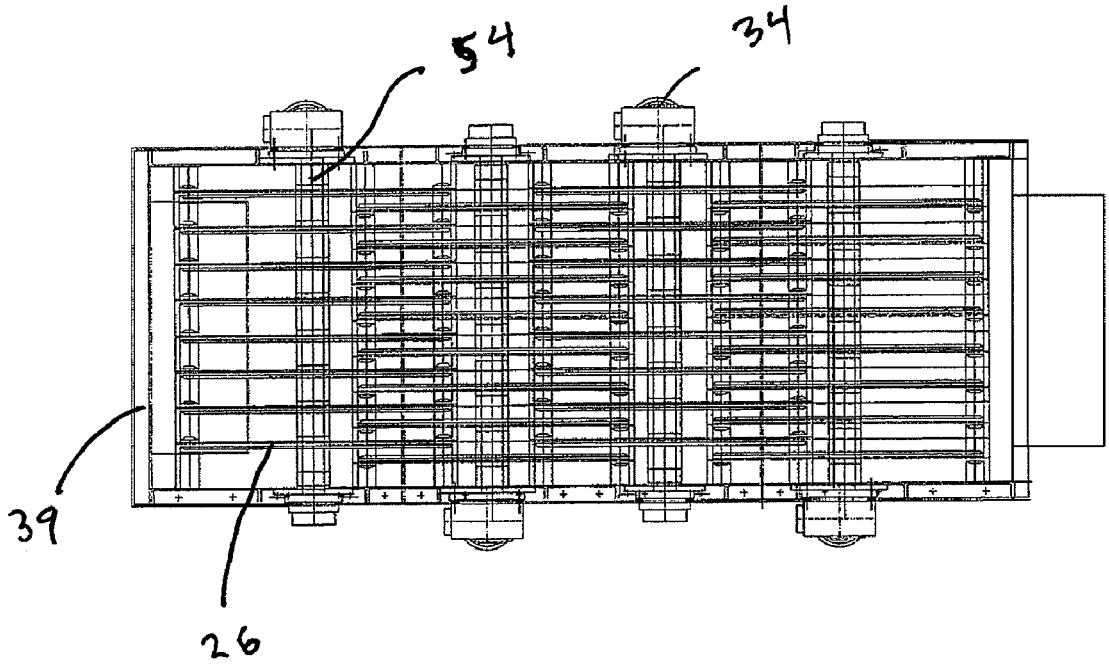
FIG. 5 shows a diagrammatic representation of a second embodiment of the disc mill seen from above.
Figure 6:
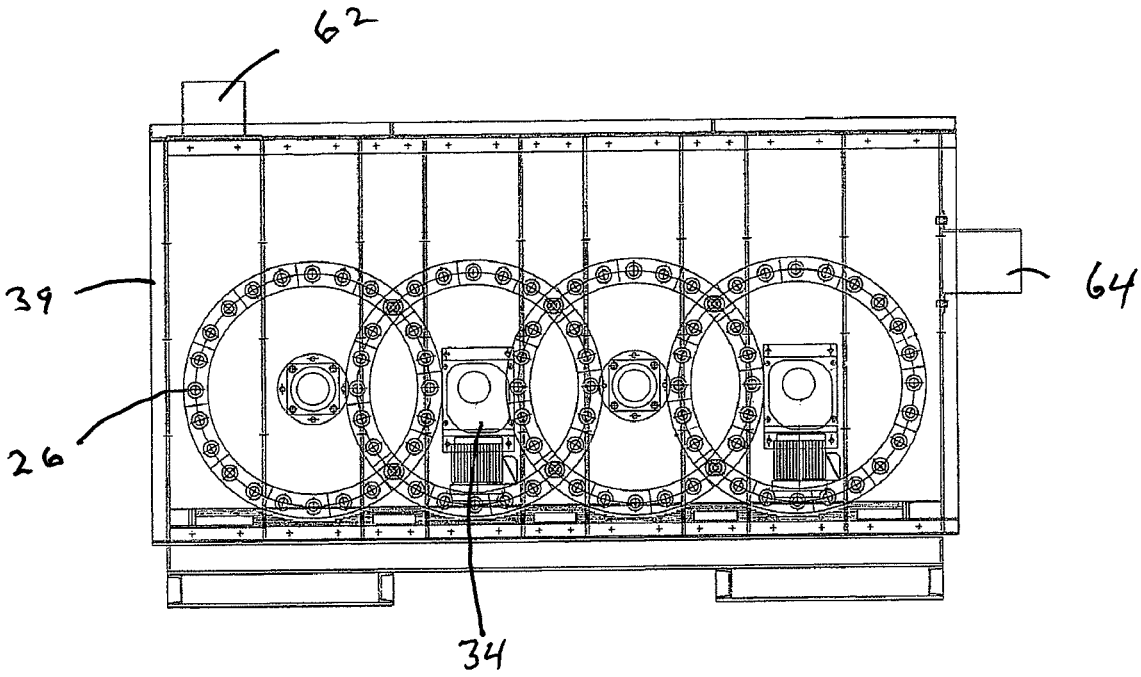
FIG. 6 is a diagrammatic view of the embodiment of FIG. 5 seen from the side.
Figure 7:
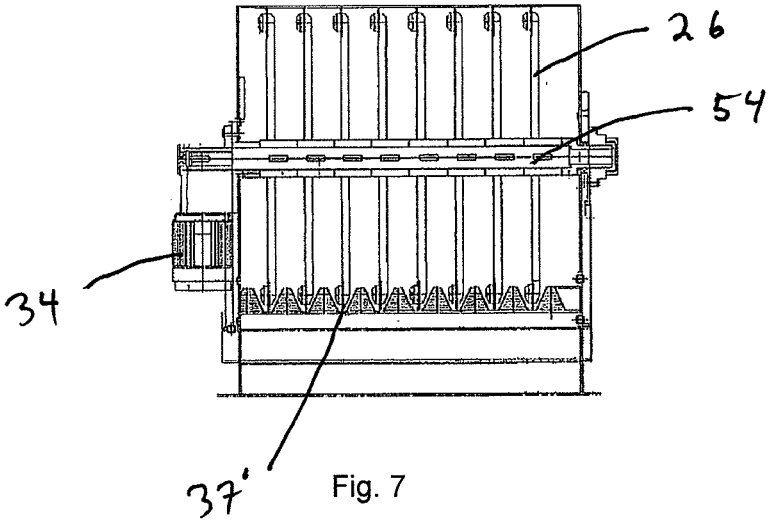
FIG. 7 is diagrammatic view of a cross section of the embodiment of FIG. 5 taken along the line 7-7 in FIG. 6
Figure 8:
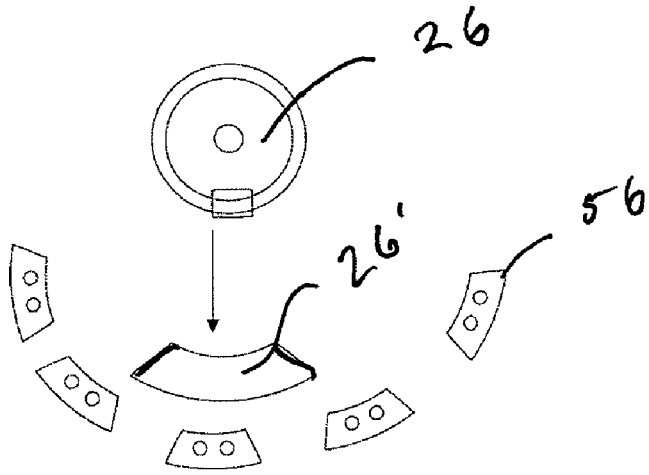
FIG. 8 is a diagram of the disk used in the embodiment of FIG.
Figure 9:
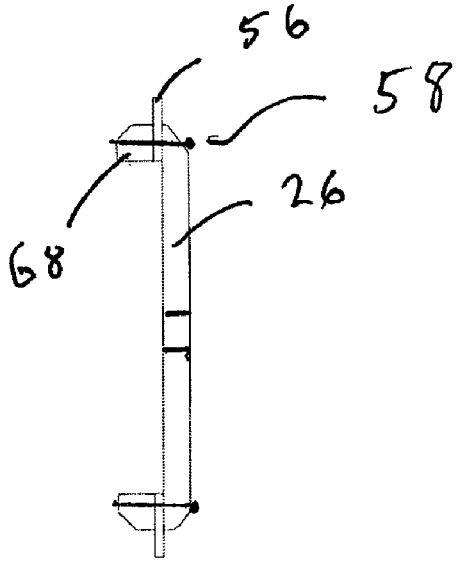
FIG. 9 is cross-section of the disk shown in FIG. 8.

The second embodiment of the disk mill disruptor was designed to overcome the drawbacks to the first embodiment discussed above. FIG. 5 shows a simplified diagram of this embodiment as viewed from above. A closed enclosure 39 contains a plurality of horizontal shafts 54, here four in number. Each shaft 54 is directly coupled to a motor 34. Rotating disks 28 are attached to each shaft 54 in a spaced apart manner with the shaft passing through the center of each disk 28. In the figure each shaft 54 bears eight disks 26 and the disks 26 on adjacent shafts 54 are offset along the length of the shafts 54 so that the disks 26 on adjacent shafts 42 can be interdigitated or overlapped. In the actual device the disks 26 are about 800 mm in diameter FIG. 6 shows the apparatus from the side further illustrating overlap of the disks 26 on adjacent horizontal shafts 54. As shown in FIG. 7 the outer perimeter of each disk 26 rotates within a straight V-groove 37'. That is, the structure of the first embodiment requires that the V-grooves 37 be circular. Here the V-grooves 37' are linear running the length of the device. FIGS. 8 and 9 diagrammatically show that the outer edges of the disks 26 are provided with extensions 56 which are dimensioned to penetrate almost to the bottoms of the V-grooves 36'. FIG. 8 shows a disk 26 out of which an enlarged portion 26' bears extensions 56 with each extension 56 being curved so as to follow the circumference of the disk 26. The extensions 56 are attached to the disk edge by means of bolts 58 (although any other appropriate mechanical fastener could be used as well). FIG. 9 shows a cross-section of the disk 26 taken along a ray of the circular disk to illustrate method of attaching the extensions 56. Because the extensions 56 penetrate into the V-grooves 37' a majority of the contact between the biomass particles and the disk 26 occurs on the extensions 56 which can be readily replaced when significant wear has occurred. Again, all parts of the device that contact the biomass are constructed from stainless steel or other resistant material. Note that the bolts 58 are used in conjunction with beveled washers 68 which more securely hold the extensions 56 in place and also provide air turbulence to move and mix the micropowder.

During operation the discs 26 typically revolve at a speed of about 150 RPM. Biomass (shredded material with a maximum dimension of about 10 mm) is introduced through an entry port 62 (FIG. 6) and is swept into the V-grooves 37'. The rotating disk 26 pulverize the biomass and sweep it along to an output port 64 where the micropowder is passed through a classification device 66 where the micro-powder is separated according to size. Classification can be achieved gravimetrically by blowing the micropowder up into a separation tower (with or without baffles) where the smallest particles (finished product) are withdrawn from the top of the tower. Larger particles are withdrawn from the base of the tower because the finer particles remained suspended in the air stream for a longer period of time (the finest particles can form a colloidal suspension in air). The larger particles are then recycled through the device for additional disruption. This same classification method is useful with the rotary disruptor already described. Other classification methods using screens and or powder cyclone separators or combinations of such methods can also be used. The device pictured (four horizontal shafts with eight 800 mm diameter discs per shaft) disrupts about two tons of biomass per 10-12 hours. The device capacity can be readily increased by simply adding additional shafts (i.e., making the length of the device longer) and/or by adding discs to each shaft (i.e., making the width of the device longer).

However, the typical product produced by the linear machine is somewhat larger particle-wise (fewer sub-micrometer particles) than the rotary device. It is believed that this is due to the effect of the disk edges passing into the groove and then lifting out while the disk of the rotary device maintains more contact with the groove by "rolling into" and out of the groove. The net effect is that the rotary disk provides more crushing and shear forces which are more effective at breaking down the biomass particles into still smaller particles. On the other hand, the linear device is relatively insensitive to variations in moisture levels as the "in and out" motion of a particular point on the rotating disk as it interacts with the grooves, sweeps the grooves clean of any particle aggregates. While the linear device can produce very fine micropowder by considerably extending its operation cycle, the most efficient results are achieved by preprocessing the shredded biomass with the linear unit to achieve particles mostly in the sub 100 μm size range, and then completing the processing with the rotary device to achieve micropowders with maximum particle size below about 10 μm with a substantial percentage of the particles having maximum dimensions in the sub-micrometer range.

This approach yield excellent quality micropowder, the step of preprocessing with the linear device entirely prevents the aggregate groove clogging that some times afflicts the rotary device. Biomass preprocessed with the linear unit is of such a size and consistency that clogging of the grooves does not occur. The alternate approach, which is presently preferred, is to use the disruptor (rather than the linear disk mill) to reduce biomass to the 100 μm size range and then to use the rotary disk mill for further processing.

The linear disk mill described above effectively processes about 2 metric tons in 10 hours. That is, it can output about 200 kg of biomass per hour. The experimental unit uses electric motors and requires about 3 kW of power per hour. The rotary disk mill described above (operating diameter of approximately 90 cm) can completely process only about 20 kg of material per hour. Therefore, either ten units must be connected to each linear disk mill, or else higher capacity rotary disk mills are required. Using electric motors a rotary disk mill currently uses between about 2.5 and 5 kW of power per metric ton of biomass. Thus, with the current experimental equipment a metric ton of biomass requires about 20 kW of electric power for disruption. It is likely that more efficient devices using motive power sources more economical than electric motors can be readily devised.

The presently preferred alternative embodiment of the process starts with a Shredder/chipper which can reduce (on lab scale) 25 kg of dried biomass to 3 mm pieces in 10 min. This is then fed into the disruptor (FIG. 1) which reduces the material to sub millimeter size in less than 60 min. This is then fed to rotary disk mill (FIG. 2) which reduces the material to sub 100 micrometer stage in 30 min. Finally this material is processed in the high speed micro-disruptor/mixer which produces a micrometer to submicrometer powder in 1-2 hr.

Figure 10:
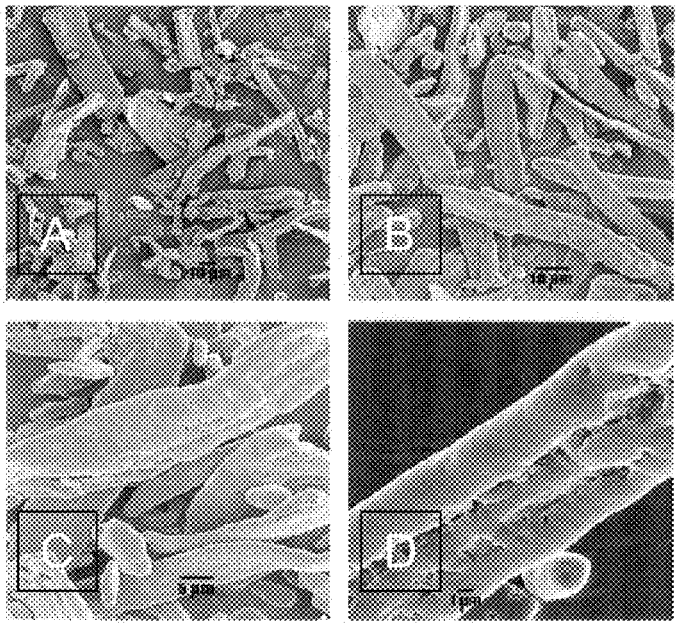
FIG. 10 is a SEM image of wood pulp from a dicotyledonous tree to illustrate the element of wood pulp; the micrometer bars show that magnification of the images increases from FIG. 10A to FIG. 10D.

The effect of the inventive process can be best appreciated by comparing the size of the cellulosic powder developed by traditional processes as compared to the inventive process. FIG. 10 shows an SEM (scanning electron microscope) image of traditional wood pulp made from a dicotyledonous tree. The typical pulping method macerates wood chips chemically after which the cellulosic components of the wood are separated mechanically. The micrometer bars in the figures demonstrate that the figures show an increase in magnification from FIG. 10A to FIG. 10D with the latter being at approximately ten times the magnification of the former. The figures also reveal that the largest cellular features—mostly cell walls of vessel elements—are largely intact.

Figure 11:
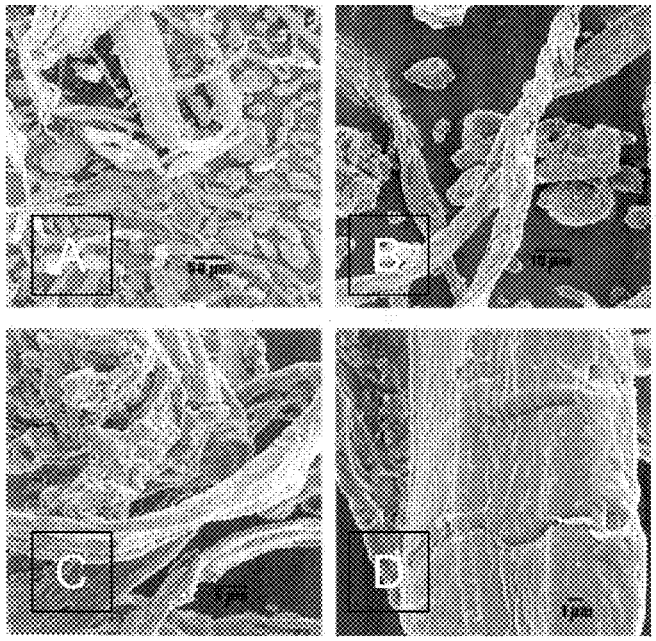
FIG. 11 is an SEM image of paper pulp from kenaf (*Hibiscus cannabinus*) produced by an exploding disruption system; the micrometer bars show that magnification of the images increases from FIG. 11A to FIG. 11D.

FIG. 11 shows a similar set of SEM images of the dicotyledonous kenaf wood disrupted by a prior art pressure explosion method. Kenaf is woody shrub that is being cultivated as a paper pulp source. The explosion method has been developed as a simplified method for disruption of cellulosic biomass to facilitate enzymatic digestion, chemical hydrolysis and related biomass processes. An inspection of FIG. 11A to 11D reveals that the large cellular vessel elements are largely undisrupted. If anything explosion disruption is not significantly more effective than traditional chemical pulping methods at reducing the cellulosic elements into small, readily enzyme digestible particles.

Figure 12:
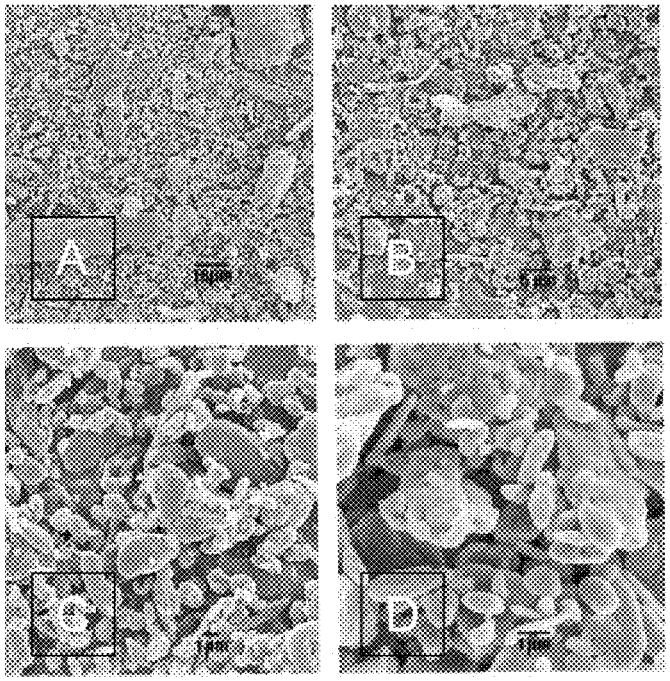
FIG. 12 is a SEM image of wood micro-powder from a coniferous tree (*Larix kaempfen*) produced according to the inventive method; the micrometer bars show that magnification of the images increases from FIG. 12A to FIG. 12D.
Figure 13:
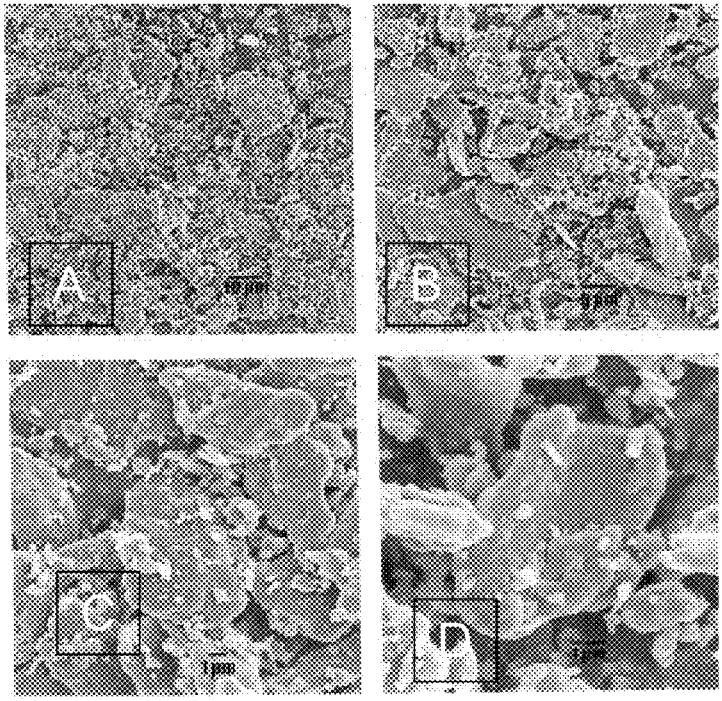
FIG. 13 is a SEM image of wood micro-powder from kenaf (*Hibiscus cannabinus*) produced according to the inventive method; the micrometer bars show that magnification of the images increases from FIG. 12A to FIG. 12D

FIGS. 10 and 11 should be contrasted to FIGS. 12 and 13. FIG. 12 shows the inventive disruption process applied to the wood of Japanese larch. FIG. 12D shows that the disruption produces a significant number of cellulosic particles below about 1 μm in diameter whereas many of the particles are in the 2-3 μm range (note that most of the larger particles appear to be aggregates of smaller particles). FIG. 13 shows SEM images of disrupted wood of kenaf. Although some particles in the 10 μm range remain, FIG. 13D shows a number of particles in the micrometer to sub-micrometer size range. Material produced by the explosion treatment show few if any particles in this size range. All of the large fibers and vessel elements shown in FIG. 11 have been disrupted by the inventive treatment. Because the inventive disruption method can be equipped with a classification device (explained below), the larger (i.e., greater than 1 μm) particles can be automatically recycled for additional disruption, the process can be readily "tuned" to produce primarily sub-micrometer particles.

The present inventor has made the unexpected discovery that with optimal combustion methods micropowder prepared according to this invention is an excellent industrial fuel for replacing fuel oil or natural gas to generate heat. The burning of micropowder is mainly a gas-phase oxidation such as that of natural gas or fuel oil (which is burned as small droplets in an aerosol). Coal too is sometimes burned as a powder formed by roller mill. Such combustion is not like that of burning a lump of coal, but because of the small particles (and correspondingly large surface areas) involved, the reaction begins to approach the oxidation reaction between gases—for example, oxygen and methane. Similarly, burning micropowder is not like burning a log or piece of wood. The extremely small particle size makes combustion of micropowder even more like a gas-gas reaction.

Test ignitions of plant micropowder samples show relatively low ignition temperatures and the ability of the powder to sustain continuous combustion and resulting release of significant quantities of energy. However, micropowder combustion is not as easily sustained as is true gas phase combustion. A continuous and constant fuel supply is critical. To achieve this pressure, mixing and vibration are involved in moving the micropowder and suspending it in a combustible state. It tends to de difficult to maintain a constant controllable flow of micropowder by means of pressure alone. Rather it is necessary to slowly stir the bulk micropowder while applying some pressure to get the material to flow. High speed stirring does not work as expected since the stirring device simply moves through the micropowder without contributing to the overall fluidization of the bulk. Once the micropowder has flowed to the site of combustion, air pressure can be applied to completely disperse the micropowder. As the micropowder approaches the point of dispersion, the entire feed path is vibrated to ensure optimal fuel feeding and dispersion. Vibration can be provided by an unbalanced rotating shaft in contact with the device; piezoelectric devices, "voice coil" systems and other well-known transducers can also be used to provide the vibration. The vibration frequency is advantageously adjustable, and the optimum vibration frequency is generally between 50 and 500 Hz.

Once the vibrated micropowder reaches the "burner" it is mixed with and dispersed by a stream of pressurized air. The powder/air mixture expands into a combustion space where it can be ignited by a spark, a glow plug, flame, heated coil or by a similar ignition device. It is important to maintain a proper air-fuel ratio of about 5:1. This value is small as compared to optimal ratios for coal, gasoline, fuel oil or natural gas. For example, the optimum air-fuel ratio for gasoline is around 15:1. The total amount of heat generated per unit time is controlled by varying the weight of micropowder delivered per unit time. The average value for burning dry wood is known to be about 4300 kcal/kg. Thus, it is fairly easy to arrange for a micropowder burner to operate at a known set value such as 50,000 kcal/hr which would require about 200 g of micropowder per minute. Similarly, a 200,000 kcal/hr burner would require about 800 g of micropowder per minute. Unlike the burning of a piece of wood micropowder combustion is essentially complete. The resulting ash is very light and usually represents about 50% to 70% of the volume of the original micropowder. The ash weight is generally between 1% and 10% of the original micropowder weight depending on the source of the original biomass with wood having a generally low ash value as compared to bagasse or similar biomass.

Figure 14:
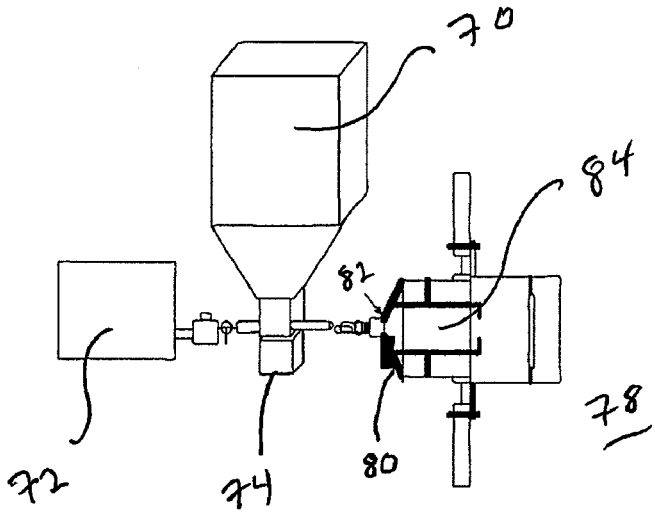
FIG. 14 shows a diagram of a combustion system based on the micropowder.

FIG. 14 shows a diagram of a system for burning the micropowder. In this diagram a storage silo 70 for the micropowder is located in close proximity to the burner 84. However, it will be appreciated that ducts containing stirring devices (e.g., linear screws or conveyors) can be used to conduct the micropowder much as if it were a fluid so that the main storage silo can be a distance from the burner. In the figure a vibration source 74 is combined with an air pressure source 72 to fluidized the micropowder in a mixer 82. The micropowder enters the burner 84 assembly where an additional pressurized air source suspends the micropowder. The additional air source and the vibration-induced micropowder flow rate are adjusted to maintain the optimum air-fuel mixture in the burner. An igniter 80 (e.g., glow plug or spark) ignites the air fuel mixture and the resulting ignition cloud is directed into the heat exchange portion of, for example, a boiler 78. The ignition cloud is a forced flame jet not unlike the flame formed by a conventional fuel oil burner. The resulting ash is extremely fine and light and is recovered from the exhaust air stream existing the boiler heat exchanger using technology well-known in the art of coal fired power systems. Unlike coal ash, the micropowder ash is free from toxic compounds and heavy metals. Because it consists of minerals removed from the soil by the plants whose biomass became the micropowder, it can be safely added back to the soil for disposal purposes.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A process for producing micropowder from cellulosic biomass for enzymatic digestion or direct combustion comprising the steps of:

shredding or chipping the biomass to produce particles having a maximum dimension of about 3-5 mm;

processing the shredded biomass to reduce the maximum diameter of the particles to about 1 mm or less;

treating the processed biomass with a rotary disk mill to reduce the maximum particle size to less than 100 micrometers in diameter wherein revolving axels bear disks the edges of which travel in circular v-shaped grooves and disrupt the particles by pressing the particles between the edges and the v-shaped grooves.

2. The process according to claim 1, further comprising the step of disrupting the biomass particles from the rotary disk mill with a microdisruptor wherein counter revolving shafts rotate bearing paddles suspend and disrupt the particles and wherein the shafts revolve at speeds of at least several thousand revolutions per minute.

3. The process according to claim 1, wherein the step of processing uses a disruptor wherein counter revolving shafts bearing paddles suspend and disrupt the particles and wherein the shafts revolve at speeds under about 500 revolutions per minute.

4. The process according to claim 1, wherein the step of processing uses a linear disk mill wherein revolving shafts bear disks the edges of which disrupt the particles by pressing the particles between the edges and linear v-shaped grooves.

* * * * *